US006991197B2

(12) United States Patent
Cox et al.

(10) Patent No.: US 6,991,197 B2
(45) Date of Patent: Jan. 31, 2006

(54) WEBBED FLANGE FOR A REEL

(75) Inventors: Gary L. Cox, Richmond, IN (US); Gerald H. Davis, Fountain City, IN (US); Chad L. Eversole, Richmond, IN (US)

(73) Assignee: Vandor Corporation, Richmond, IN (US)

( * ) Notice: Subject to any disclaimer, the term of this patent is extended or adjusted under 35 U.S.C. 154(b) by 98 days.

(21) Appl. No.: 10/685,075

(22) Filed: Oct. 14, 2003

(65) Prior Publication Data

US 2005/0077423 A1 Apr. 14, 2005

(51) Int. Cl.
*B65H 75/14* (2006.01)
*B65H 75/18* (2006.01)

(52) U.S. Cl. ..... 242/614.1; 242/608.3; 242/608.4; 242/610.4

(58) Field of Classification Search ..... 242/608.3, 242/608.4, 610.4, 614, 614.1, 118.61, 118.62
See application file for complete search history.

(56) References Cited

U.S. PATENT DOCUMENTS

| | | | | |
|---|---|---|---|---|
| 1,911,427 | A * | 5/1933 | Bureau | 242/614.1 |
| 3,108,758 | A * | 10/1963 | Hill | 242/614.1 |
| 3,565,363 | A * | 2/1971 | Mizuguchi et al. | 242/608.4 |
| 5,897,075 | A | 4/1999 | Elder et al. | |
| 6,234,421 | B1 | 5/2001 | Cox et al. | |
| 6,598,825 | B2 * | 7/2003 | Ripplinger | 242/608.3 |
| 6,715,710 | B1 * | 4/2004 | Russell et al. | 242/614 |

* cited by examiner

*Primary Examiner*—Gene O. Crawford
*Assistant Examiner*—Evan H. Langdon
(74) *Attorney, Agent, or Firm*—Maginot Moore & Beck

(57) ABSTRACT

A flange is for use in a reel for supporting a wound flexible medium. The reel includes an elongated core defining a longitudinal core axis. The flange includes a first annular wall oriented substantially perpendicular to the axis and engaging the core. A second annular wall is oriented substantially perpendicular to the axis and is offset in an axial direction from the first annular wall. At least one connecting wall interconnects the second annular wall and the first annular wall. A first annular rim is attached to the first annular wall or the second annular wall and is oriented substantially parallel to the axis.

40 Claims, 3 Drawing Sheets

WEBBED FLANGE FOR A REEL

FIELD OF THE INVENTION

The present invention relates generally to reels for supporting wound flexible media, and in particular, to reels having a core and at least one flange that is attachable to the core.

BACKGROUND OF THE INVENTION

Reels for supporting wound flexible media are employed to both store and facilitate the dispensing of wound media such as rope, wire, chain, and strings of parts. The essential elements of a reel include its core, around which the flexible medium is wound, and its flanges, which prevent the wound flexible medium from migrating axially off of the core. Reels intended for industrial use can vary greatly in size.

Well-designed reels must combine a high strength-to-weight ratio with low manufacturing cost. One reel design that has gained popularity is a reel in which the core is constructed of a pressed paperboard material and the flanges are constructed of a composite or plastic material. The use of paper and plastic components, in general, provides a high strength-to-weight ratio and facilitates the use of relatively straightforward and relatively inexpensive manufacturing techniques. Another lightweight reel design consists of a pressed paperboard core and corrugated paper flanges. While such all-paper reels provide significant economy and light weight, all-paper reels are generally not suitable for certain medium to heavy duty applications because the paper flanges do not have the strength of plastic, wood, or steel flanges. Accordingly, for medium to heavy duty reel applications, plastic or composite flanges provide an advantageous combination of manufacturability, light weight, and strength.

Reels having composite or plastic flanges are relatively simple to manufacture. The flanges may be formed using known injection molding techniques. The flanges are then attached to the core to form a reel.

During use, reels are subject to many extraneous forces which can possibly damage the reels. For instance, a user may grip the reel by one of its flanges and lift the reel off of the floor. If the reel is not carrying any wound media, the reel is less susceptible to damage from such lifting. On the other hand, if the reel is loaded with a heavy metal wound medium, then the weight of the loaded reel can cause the gripped flange to bend and/or warp when the reel is lifted by the flange. In order to avoid damage caused by such lifting, the typical flange is designed with wall thicknesses that are sufficient to provide the necessary strength and structural integrity. Of course, with increased wall thicknesses also comes increased material costs and weight, neither of which is desirable.

Another way in which a reel may be damaged is if an extraneous force is exerted on a flange, such as if the reel is dropped. Such a force exerted on a flange will usually damage the pressed cardboard core. Particularly subject to damage are the ends of the core that engage the flanges. It has been found that an end of a core tends to tear or buckle inwardly when a sufficient force is exerted on the corresponding flange.

What is needed, therefore, is a reel that is less subject to damage from extraneous forces and yet does not require an increased amount of material.

SUMMARY OF THE INVENTION

The present invention fulfills the above need, as well as others, by providing a reel including a flange that has features that inhibit bending and warping of the flange and that prevent damage to the core. More specifically, the flange includes support ridges on both its inner and outer sides for inhibiting bending, flexing, and warping of the flange. The flange also includes concentric walls that define a groove for receiving the end of the core. In addition to further inhibiting bending, flexing, and warping of the flange, the walls support the end of the core to thereby prevent damage thereto.

An exemplary embodiment of the present invention includes a flange for use in a reel for supporting a wound flexible medium. The reel includes an elongated core defining a longitudinal core axis. The flange includes a first annular wall oriented substantially perpendicular to the axis and engaging the core. A second annular wall is oriented substantially perpendicular to the axis and is offset in an axial direction from the first annular wall. At least one connecting wall interconnects the second annular wall and the first annular wall. A first annular rim is attached to the first annular wall or the second annular wall and is oriented substantially parallel to the axis.

Another exemplary embodiment of the present invention includes a flange for use in a reel for supporting a wound flexible medium. The reel includes an elongated core defining a longitudinal core axis. The flange includes a first annular wall having a center portion engaging the core. The first annular wall is oriented substantially perpendicular to the core axis when engaged to the core. A second annular wall is oriented substantially perpendicular to the core axis and is offset from the first annular wall in a first axial direction relative to the core axis. A plurality of circumferentially spaced substantially U-shaped support beams emanate radially from the center portion. Each of the support beams includes a pair of radially extending connecting walls oriented substantially parallel to the core axis and connected to the second annular wall.

Yet another exemplary embodiment of the present invention includes a flange for use in a reel for supporting a wound flexible medium. The reel includes an elongated core defining a longitudinal core axis. The flange includes a first annular wall oriented substantially perpendicular to the axis. A plurality of first support ridges project from the first annular wall in a first axial direction substantially parallel to the axis. A second annular wall is oriented substantially perpendicular to the axis and is offset from the first annular wall in the first axial direction. The second annular wall is attached to the first annular wall. A plurality of second support ridges project from the second annular wall in a second axial direction substantially opposite to the first axial direction. The first support ridges and the second support ridges are all intersected by a common imaginary plane that is oriented substantially perpendicular to the axis.

A further exemplary embodiment of the present invention includes a flange for use in a reel for supporting a wound flexible medium. The reel includes an elongated core defining a longitudinal core axis. The flange includes a first annular wall oriented substantially perpendicular to the axis and engaging the core. A plurality of first support ridges project from the first annular wall in a first axial direction substantially parallel to the axis. A second annular wall is oriented substantially perpendicular to the axis and is offset in the first axial direction from the first annular wall. The second wall is attached to the first annular wall.

A still further exemplary embodiment of the present invention includes a flange for use in a reel for supporting a wound flexible medium. The reel includes an elongated core defining a longitudinal core axis. The flange includes a first annular wall oriented substantially perpendicular to the axis and engaging the core. A second annular wall is oriented substantially perpendicular to the axis and is offset in an axial direction from the first annular wall. The second annular wall is attached to and disposed radially outward of the first annular wall. A beam wall is oriented substantially coplanar with the first annular wall and is disposed radially outward of the first annular wall. At least one connecting wall interconnects the second annular wall and the beam wall. The beam wall and the at least one connecting wall define a support beam therebetween.

Another exemplary embodiment of the present invention includes a flange for use in a reel for supporting a wound flexible medium. The reel includes a core. The flange includes an annulus having an inner side engaging the core. The inner side has a plurality of circumferentially-spaced indentations separated by a plurality of unindented portions interleaved between the indentations. The indentations are spaced around an entire circumference of the annulus such that each unindented portion spans less than 180° in a circumferential direction.

Yet another exemplary embodiment of the present invention includes a flange for use in a reel for supporting a wound flexible medium. The reel includes an elongated core defining a longitudinal core axis. The flange includes a substantially planar first web oriented substantially perpendicular to the axis. The first web includes a center portion engaging the core. A radially-oriented finger emanates from the center portion. A substantially planar second web is oriented substantially perpendicular to the axis and is offset in a first axial direction from the first web. The second web is attached to and disposed radially outward of the first web. At least one connecting wall interconnects the second web and the finger of the first web. The finger and the at least one connecting wall define a support beam therebetween.

An advantage of the present invention is that, because the flange includes support ridges on both of its sides, bending and warping of the flange is inhibited regardless of which of the two opposite axial directions a force is exerted on the flange. Yet another advantage is that the flange includes concentric walls defining a groove that supports and prevents damage to an end of the core that is received in the groove.

Still another advantage is that more structural strength of the flange can be achieved with less flange material than with prior flange designs. A more specific advantage is that he wall or web thickness of the flange material can be significantly reduced from prior flange designs. This reduction in thickness reduces material costs without sacrificing strength. A further advantage is that the inventive flange is easier to manufacture by standard injection molding processes, while minimizing hot spots or discontinuities in the molded material.

A further advantage of the present invention is that, by virtue of the support ridges and the concentric walls sharing a same position in the axial direction, the overall height of the flange is limited. These advantages, as well as particular benefits of the invention, will become more readily apparent to those of ordinary skill in the art by reference to the following detailed description and accompanying drawings.

DETAILED DESCRIPTION OF THE PREFERRED EMBODIMENTS

Figure 1:
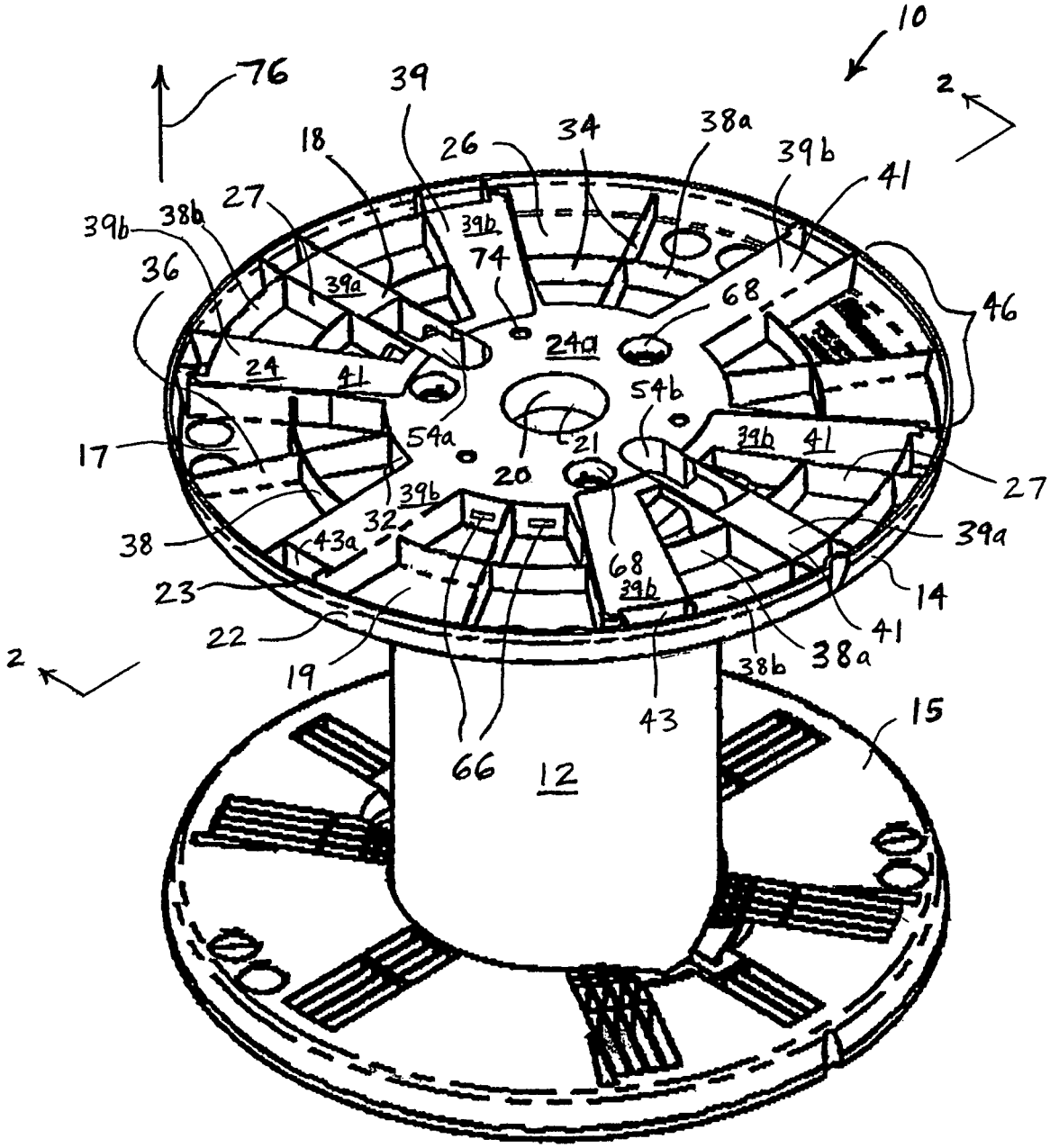
FIG. 1 shows a perspective view of an exemplary embodiment of a reel according to the present invention.
Figure 2:
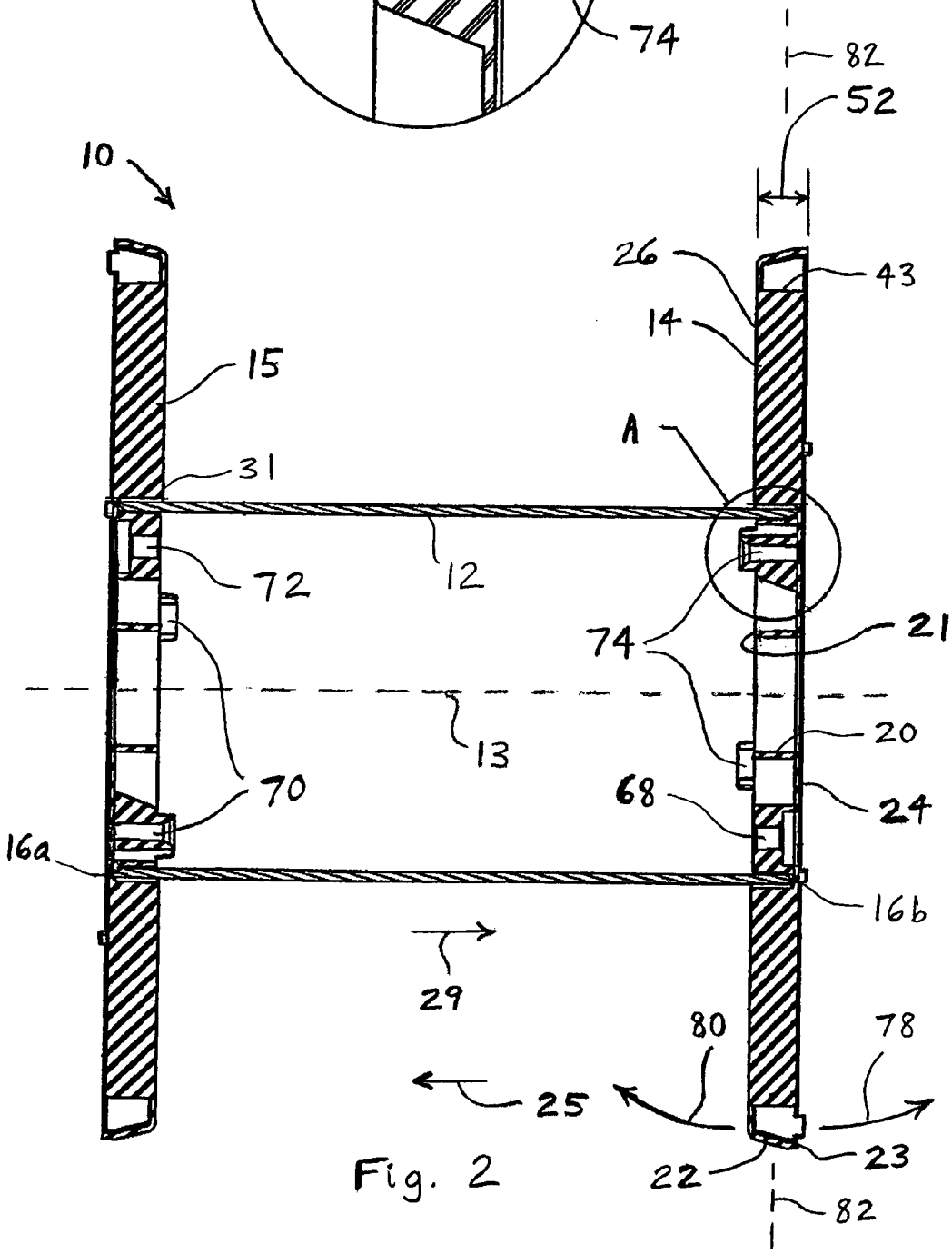
FIG. 2 shows a cutaway cross-sectional view of the reel along line 2—2 in FIG. 1.

FIG. 1 shows one embodiment of a reel 10 according to the present invention which includes a core 12, a first flange 14 and a second flange 15. As shown in FIG. 2, the core 12 defines an axis 13 and has two opposite ends 16*a*, 16*b* each having a generally circular shape. It is noted that the core 12 typically, but not necessarily, has a substantially uniform shape along its length so the core assumes the configuration of a hollow cylinder. In the exemplary embodiment described herein, the core 12 can comprise a pressed paperboard tube.

The flanges 14, 15 are preferably molded of a plastic or composite material. However, metal and other rigid materials may be used while still retaining many of the advantages of the present invention.

The flange 14 comprises an annulus 18 having a plurality of circumferentially-spaced indentations 19 on a radially outer portion of an axially outer side 17 of the annulus 18. The annulus 18 also has an inner annular rim 20 defining an inner edge 21 and an outer annular rim 22 defining an outer edge 23, as shown in FIG. 1. The inner annular rim 20 extends axially inward, i.e., in a direction indicated by arrow 25, from an axially outer first annular wall or planar web 24, as shown in FIG. 2. The outer annular rim 22 extends axially outward, i.e., in a direction indicated by arrow 29, from an axially inner second annular wall or planar web 26. The axially outer first annular wall 24 and the axially inner second annular wall 26 are each oriented substantially perpendicular to the axis 13 and parallel to each other. The inner and outer rims 20, 22 are each oriented substantially parallel to the axis 13 and concentric with each other. In the exemplary embodiment described herein, the inner and outer rims 20, 22 are substantially circular. It will be noted however, that the exact shapes of the rims can be varied depending on the requirements of the application for the reel 10.

As shown in FIG. 2, the outer annular wall 24 is displaced from the inner annular wall 26 in axial direction 29. Emanating radially outwardly from the center portion 24*a* of the outer annular wall 24 are a plurality of fingers or support beam walls 39. The beam walls 39 are generally coplanar with each other and with an annular, core-engaging center portion 24*a* of the outer annular wall 24. The center portion 24*a* defines an axis that coincides with the core axis 13. Some of the beam walls 39*a* are shorter than other beam walls 39*b*. The inner annular wall 26 is connected to the walls 39 by radially extending connecting walls 27 and circumferentially extending end walls 43. In the embodiment shown, the connecting walls 27 and end walls 43 are oriented parallel to the axis 13. The support beam walls 39, the connecting walls 27 and the end walls 43 form a plurality of beams or support beams 41 that are generally U-shaped in cross section.

Figure 4:
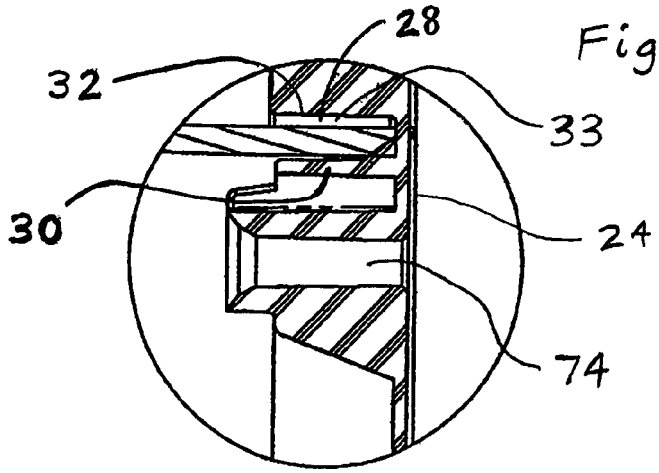
FIG. 4 shows an enlarged view of area A in FIG. 2.
Figure 3:
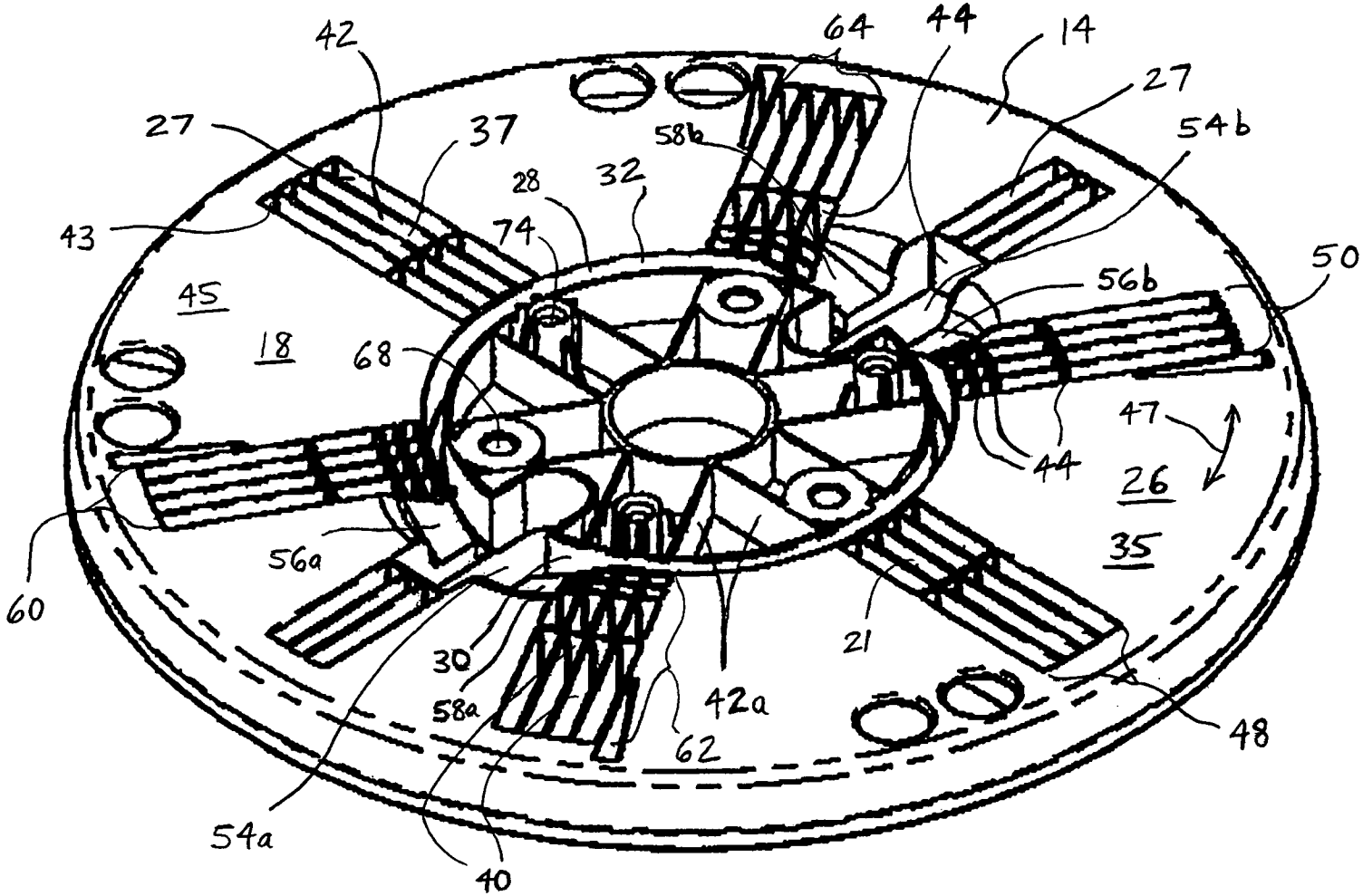
FIG. 3 shows a perspective view of one of the flanges of FIG. 1.

As best seen in FIGS. 3 and 4, the flange 14 includes a circular groove 28 defined by the axially outer annular wall 24, an axially extending annular inner hub wall 30 and an axially extending annular outer hub wall 32. The inner hub wall 30 and outer hub wall 32 are concentric and provide the groove 28 with a shape that corresponds to the shape of the end 16*b* of the core 12. Preferably, this shape is circular. The inner hub wall 30 extends axially inward from the outer annular wall 24, as shown in FIG. 4. The outer hub wall 32 interconnects the outer annular wall 24 and the inner annular wall 26, as seen in FIG. 1. Preferably, the outer hub wall 32 is integrated with the connecting walls 27 to provide flexural stiffness to the flange 14. In a specific embodiment, the heights of both the inner hub wall 30 and the outer hub wall 32 are approximately between 0.25 inch and 1.0 inch. In the specific illustrated embodiment, both the inner hub wall 30 and the outer hub wall 32 have a height of approximately 0.625 inch. Each of the indentations 19 is defined by the outer rim 22, two respective connecting walls 27, and the outer hub wall 32.

The groove 28 defined by the hub walls 30, 32 receives the end 16*b* of the core 12 therein such that the end 16*b* is surrounded by the wall 32 and the end 16*b* surrounds the wall 30. More particularly, both the outer hub wall 24 and at least the proximal end of the inner hub wall 30 engage and support the end 16*b* of the core 12. As can be seen in FIG. 4, the inner hub wall 30 angles or tapers radially inwardly toward the distal end of the wall 30 such that the distal end of the wall 30 may not engage the core 12. This tapering of the groove 28 serves to guide the end 16*b* of the core 12 into the groove 28 and prevent damage to the end 16*b* as the end 16*b* enters the groove 28. The base of the inner hub wall 30 can have a diameter greater than the inner diameter of the end 16*b* of the core 12 so that the wall 30 tends to angle the end 16*b* outward to help fix the end 16*b* in position. In a similar fashion, the flange 15 includes a groove 31 that receives and supports the end 16*a* of the core 12 therein.

The support of the inner hub wall 30 inhibits the end 16*b* from collapsing in a radially-inward direction. This support provided by the radially inner wall 30 may be particularly needed in the event of an external force being exerted upon the flange 14. Without the support of the wall 30, such an external force could cause the end 16*b* of the core 12 to collapse or buckle in the radially-inward direction.

The outer hub wall 32 does not normally engage the end 16*b* of the core 12. Rather, there is a gap 33 between the outer hub wall 32 and the end 16*b* of the core 12. However, if the core 12 were to buckle due to external forces, then the outer hub wall 32 may come into contact with and support the end 16*b* of the core 12. The gap between the end 16*b* and the outer wall 32 can be generally on the order of one-sixteenth inch. Thus, the outer hub wall 32 can prevent further buckling and tearing of the core 12.

In one aspect of the invention, the flange 14 can include a plurality of outer support ridges 34 extending in an axially outward direction from the inner annular wall 26, as shown in FIG. 1. That is, the outer support ridges 34 project in axial direction 29 from the inner annular wall 26. The support ridges 34 are preferably arranged in a web of radially-oriented ridges 36 and circumferentially-oriented ridges 38. The radial ridges 36 bridge the radial space between outer hub wall 32 and rim 22. The circumferential ridges 38 span the circumferential space between walls 27 of the support beams 39. Radially innermost circumferential ridges 38*a* can intersect the radial ridges 36.

Radially outermost ones 38*b* of the circumferential ridges are circumferentially aligned with the end walls 43 of the support beams 39. As can be seen in FIG. 1, two of the ridges 38*b* interconnect the end walls 43 of one set of three adjacent support beams 39, and the other two of the ridges 38*b* interconnect the end walls 43 of another set of three adjacent support beams 39. The two sets of three support beams 39 are separated by shorter beams 39*a*. Two opposing beams 39*b* are diametrically opposite each other and include discrete end walls 43*a* that do not engage any of the ridges 38*b*.

In a further feature of the invention, an outer portion of an inner side 35 of the annulus 18, i.e. the annulus side 35 that engages the core 12 and that is opposite the outer side 17, has a plurality of circumferentially-spaced indentations 37 which are disposed so as to be complementary to the indentations 19 on the outer side 17 of the annulus 18. Each of the indentations 37 is defined by the outer hub wall 32, two respective connecting walls 27, and a respective end wall 43. Interleaved between and separating the indentations 37 are a plurality of unindented portions 45. In other words, the unindented portions 45 of the web 26 are interleaved between the fingers 39. The indentations 37 are spaced around an entire circumference of the annulus 18 such that each unindented portion 45 spans approximately between 10° and 60° in a circumferential direction indicated by double arrow 47. Each unindented portion 45 is aligned in an axial direction with a respective indentation 19.

The web 26 is in the form of an annular surface having discontinuities presented by the indentations 37. Similarly, the web 24 is in the form of an annular surface having discontinuities presented by the indentations 19.

The flange 14 can include a plurality of inner support ridges 40 extending in an axially inward direction 25 within the indentations 21 from the support beam walls 39, as shown in FIG. 3. The support ridges 40 are arranged in a web of generally radially-oriented ridges 42 and circumferentially-oriented ridges 44. The generally radially-oriented ridges 42 are disposed between the wall 32 and the end walls 43. However, some of the radially-oriented ridges 42*a* essentially extend through wall 32 and are disposed inside the walls 30, 32. These ridges 42*a* are connected to outer annular wall 24 to support the wall 24 and hub walls 30, 32 against diaphragm flexure.

The support beams 39, support ridges 34, 40 and walls 30, 32 all increase structural strength of the flange 14 over prior flange designs. For instance, in response to external forces, the support beams 39, support ridges 34, 40 and walls 30, 32 inhibit bending and warping of the flange 14. The support beam construction of the present invention allows the flange 14 to have the same wall thicknesses as prior flange designs, but with greater structural strength. If desired, the flange walls of the present invention can alternatively be made thinner than prior flange designs while retaining the same strength as the flanges of the prior art. In one preferred embodiment, the flange walls have thicknesses approximately between 0.065 and 0.080 inch.

It may be ascertained from a comparison of FIGS. 1 and 3 that sets of the outer support ridges 34 and sets of the inner support ridges 40 are disposed in a side-by-side, complementary fashion around the flange 14. More specifically, sets of outer support ridges 34 and sets of inner support ridges 40 can be alternatingly disposed around the flange 14 in a circumferential direction. In a preferred embodiment, no set of outer support ridges 34 shares the same angular position with any set of inner support ridges 40. For example, a set 46 (FIG. 1) of outer support ridges 34 is disposed between sets 48 and 50 (FIG. 3) of inner support ridges 40.

All outer support ridges 34 and inner support ridges 40 share a same position in the axial direction. Further, the outer and inner support ridges 34, 40 also share a same axial position with the radially inner and outer walls 30, 32. That is, the outer and inner support ridges 34, 40 and the groove 28 are disposed at a same position along the axis 13 of the core 12. An imaginary radially-oriented plane 82 oriented perpendicular to the axis 13 can simultaneously intersect each of the outer and inner support ridges 34, 40 and the radially inner and outer walls 30, 32. Thus, a height 52 (FIG. 2) of the flange 14, and the space occupied thereby, are advantageously minimized.

The flange 14 includes two diametrically opposed feed slots 54*a*, 54*b* (FIGS. 1, 3), each of which creates a respective discontinuity in both the radially inner wall 30 and the radially outer wall 32. An end of a wire, cable, or other medium that is wound on the reel 10 can be threaded through one of the slots 54*a*, 54*b* and secured to the flange 14 without having to cross the outer annular rim 22.

The axially inner annular wall 26 includes four ramps 56*a*, 58*a* and 56*b*, 58*b*. The ramps provide the wound medium with a gradual transition from the plane of the axially inner annular wall 26 to the slots 54*a*, 54*b*. Thus, there is no need to bend the wound medium at a ninety degree angle in order that the medium can pass through a slot. A 90 degree angle may be difficult to achieve if the wound medium is relatively thick. The gradual transition provided by the ramps also avoids the wound medium engaging a sharp corner of the flange 14 as the wound medium passes into the slot. Such a sharp corner could damage the wound medium.

Each of the ramps 56*a*, 58*a* and 56*b*, 58*b* can extend into a respective set of inner support ridges 40. That is, each of the ramps is partially formed by the distal edges of a respective set of inner support ridges 40. More particularly, the ramp 56*a* extends into a ridge set 60; the ramp 58*a* extends into a ridge set 62; the ramp 56*b* extends into the ridge set 50; and the ramp 58*b* extends into a ridge set 64. The heights of the ridges 40 change gradually along the ramps in order to provide a smooth transition.

Another advantageous feature of the present invention is that a number of the circumferentially-oriented ridges 44 can be aligned with the ramps. For example, it can be seen in FIG. 3 that two of the circumferentially-oriented ridges 44 of the ridge set 50 are disposed in the small area of the set 50 that is aligned with the ramp 56*b*. It can also be seen that only one of the ridges 44 is disposed in the much larger area of the set 50 that is not aligned with the ramp 56*b*. The circumferentially-oriented ridges 44 that are aligned with the ramps provide additional support for the wound medium that engages the ramps. The support provided by the circumferentially-oriented ridges 44 within the ramps prevents the radially-oriented ridges 42 within the ramps from cutting into the wound medium and possibly damaging the wound medium.

It is noted that while only the first flange 14 is discussed above in detail, the second flange 15 preferably has the same structure.

During assembly, the core 12 may be further secured to the flanges 14, 15 by use of staples. More particularly, staples 66 (FIG. 1) may be driven through the radially outer wall 32 and into the core 12. Although only two staples 66 are shown in FIG. 1, additional staples 66 can be inserted at various locations along the periphery of the radially outer wall 32. Similarly, staples can be driven into the radially outer wall of the flange 15 in order to secure the core 12 to the flange 15.

As an alternative to staples, the flanges 14, 15 can be attached together by bolts (not shown), thereby securely retaining the core 12 between the flanges 14, 15. The bolts can be inserted through the countersunk bolt holes 68 of the flange 14 and into the aligned bolt holes 70 in the flange 15. The ends of the bolts that are opposite the heads of the bolts can be threaded so that the bolts become threadedly coupled to the flange 15. Alternatively, or in addition, the bolts can be inserted through the countersunk bolt holes 72 of the flange 15 and into the aligned bolt holes 74 in the flange 14.

During use, a user may grab the flange 14 around its outer annular rim 22 and manually lift the reel 10 off of the floor in the upward direction indicated by arrow 76 in FIG. 1. While the reel 10 is held by the flange 14 and suspended off of the floor, the weight of the reel 10 imparts a bending force on the flange 14, tending to bend the outer portion of the flange 14 that is gripped by the user. The gripped outer portion of the flange 14 can be bent by the reel weight in either of two directions, i.e, in either the outward direction 78 or the inward direction 80 (FIG. 2), depending upon the orientation in which the reel 10 is held.

The flange 14 can also be bent in either of two directions if the user grips the flange 14 with both hands at two diametrically opposite points. For instance, if the two-handedly gripped flange is oriented substantially horizontal and disposed above the ungripped flange, i.e., with the weight of the reel pulling down on the gripped flange, then the edges of the gripped flange will tend to bend in the outward direction. If the two-handedly gripped flange is oriented substantially horizontal and disposed below the ungripped flange, i.e., with the weight of the reel pushing down on the gripped flange, then the edges of the gripped flange will tend to bend in the inward direction.

Bending of the flange 14 in the outward direction 78 tends to compress the outer support ridges 34 and stretch out the inner support ridges 40. It has been found that ridges are generally more resistant to being stretched than they are to being compressed. That is, ridges tend to buckle while being compressed, but hold up relatively well while being stretched. Thus, when an outward force in direction 78 is exerted upon the flange 14, it is primarily the stretched inner support ridges 40 rather than the compressed outer support ridges 34 that inhibit bending and warping of the flange 14.

If the flange 14 is bent in the inward direction 80, then it is the inner support ridges 40 that are compressed and the outer support ridges 34 that are stretched. Thus, in this case, it is primarily the stretched outer support ridges 34 rather than the compressed inner support ridges 40 that inhibit bending and warping of the flange 14.

As is evident from the above description, in order to inhibit bending and warping, it is advantageous for ridges to be on both sides (i.e., the inner side and the outer side) of a flange so that some ridges are stretched rather than compressed regardless of which direction the flange is bent. Thus, some ridges are always positioned to be stretched, and can thereby best inhibit bending and warping of the flange. The flange of the present invention provides such an arrangement by including both sets of outer support ridges 34 and sets of inner support ridges 40 alternatingly disposed around the flange 14. Further, by the sets of outer support ridges 34 and sets of inner support ridges 40 being widely dispersed around the flange 14, it is ensured that a stretched ridge is in close enough proximity to inhibit bending and warping of the flange 14 regardless of where along its periphery the flange 14 is gripped and regardless of in which direction the bending force is exerted.

It will be appreciated that the above described embodiments are merely exemplary, and that those of ordinary skill in the art may readily devise their own implementations that incorporate the principles of the present invention and fall within the spirit and scope thereof. For example, the number, heights and orientations of the outer support ridges 34, the spacings therebetween, and the patterns formed thereby can all readily be modified without departing from the spirit and scope of the invention. Likewise, the number, heights and orientations of the inner support ridges 40, the spacings therebetween, and the patterns formed thereby can also all readily be modified without departing from the spirit and scope of the invention. Moreover, the heights and spacing between the radially inner wall 30 and the radially outer wall 32 can be modified within the spirit and scope of the invention.

We claim:

1. A flange for use in a reel for supporting a wound flexible medium, the reel including an elongated core defining a longitudinal core axis, the flange comprising:

a first annular wall configured to engage the core and oriented substantially perpendicular to the core axis when engaged to the core;

a second annular wall oriented substantially perpendicular to the core axis and offset from said first annular wall in a first axial direction relative to the core axis; at least one connecting wall interconnecting said second annular wall and said first annular wall;

a first annular rim attached to one of said first annular wall and said second annular wall and oriented substantially parallel to the core axis;

a plurality of first support ridges projecting from said first annular wall in the first axial direction; and a plurality of second support ridges projecting from said second annular wall in a second axial direction substantially opposite to said first axial direction.

2. The flange of claim 1, wherein sets of said first support ridges and sets of said second support ridges are alternatingly disposed in a circumferential direction relative to the core axis.

3. The flange of claim 1, wherein said plurality of second support ridges include second support ridges that are oriented in a radial direction and second support ridges that are oriented in a circumferential direction relative to the core axis.

4. The flange of claim 1, wherein said at least one connecting wall comprises a plurality of connecting walls, at least one of said plurality of first support ridges being attached to at least one of said connecting walls.

5. The flange of claim 1, wherein said first annular wall includes a center portion configured to engage the core and a plurality of support beam walls emanating radially from said center portion.

6. The flange of claim 5, wherein said at least one connecting wall includes a plurality of pairs of connecting walls corresponding to each of said plurality of support beam walls, each of pairs of connecting walls connected to an associated one of said support beam walls to form a corresponding plurality of radially extending substantially U-shaped support beams.

7. The flange of claim 6, wherein at least one of said plurality of first support ridges is disposed within each of said plurality of support beams.

8. The flange of claim 6, wherein said plurality of first support ridges include support ridges oriented in a radial direction and oriented in a circumferential direction within each of said plurality of support beams.

9. The flange of claim 1, wherein:

said first annular wall includes a center portion configured to engage the core; and said at least one connecting wall includes an annular connecting wall connecting said center portion of said first annular wall to said second annular wall.

10. The flange of claim 9, wherein said first annular rim is attached to said center portion of said first annular wall radially inboard of said annular connecting wall relative to the core axis.

11. The flange of claim 10, further comprising a second annular rim attached to said second annular wall radially outboard of said annular connecting wall.

12. A flange for use in a reel for supporting a wound flexible medium, the reel including an elongated core defining a longitudinal core axis, the flange comprising:

a first annular wall having a center portion configured to engage the core, said first annular wall oriented substantially perpendicular to the core axis when engaged to the core;

a second annular wall oriented substantially perpendicular to the core axis and offset from said first annular wall in a first axial direction relative to the core axis;

a plurality of circumferentially spaced substantially U-shaped support beams emanating radially from said center portion, each of said support beams including a pair of radially extending connecting walls oriented substantially parallel to the core axis and connected to said second annular wall; and a plurality of first support ridges projecting from said first annular wall in said first axial direction and disposed within said plurality of U-shaped support beams.

13. The flange of claim 12, wherein said plurality of first support ridges includes a plurality of radially extending first support ridges disposed within each of said plurality of U-shaped support beams.

14. The flange of claim 13, wherein said plurality of first support ridges includes at least one circumferentially extending first support ridge disposed within each of said plurality of U-shaped support beams and intersecting each of said plurality of radially extending first support ridges.

15. The flange of claim 12 further comprising a plurality of second support ridges projecting from said second annular wall in a second axial direction opposite said first axial direction and disposed between each of said plurality of U-shaped support beams.

16. A flange for use in a reel for supporting a wound flexible medium, the reel including an elongated core defining a longitudinal core axis, the flange comprising:

a first annular wall oriented substantially perpendicular to the axis;

a plurality of first support ridges projecting from said first annular wall in a first axial direction substantially parallel to the axis;

a second annular wall oriented substantially perpendicular to the axis and offset from said first annular wall in said first axial direction, said second annular wall being attached to said first annular wall; and a plurality of second support ridges projecting from said second annular wall in a second axial direction substantially opposite to said first axial direction;

wherein said first support ridges and said second support ridges are all intersected by a common imaginary plane that is oriented substantially perpendicular to the axis.

17. The flange of claim 16, further comprising a groove configured to receive an end of the core, said groove being intersected by the common imaginary plane.

18. The flange of claim 16, further comprising a third annular wall oriented substantially parallel to the axis, said third annular wall being configured to engage the core, said third annular wall being intersected by the common imaginary plane.

19. The flange of claim 18, further comprising a fourth annular wall oriented substantially parallel to the axis, said third annular wall and said fourth annular wall defining a groove therebetween, said groove being configured to receive an end of the core, said fourth annular wall being intersected by the common imaginary plane.

20. A flange for use in a reel for supporting a wound flexible medium, the reel including an elongated core defining a longitudinal core axis, the flange comprising:

a first annular wall configured to engage the core and oriented substantially perpendicular to the core axis;

a plurality of first support ridges projecting from said first annular wall in a first axial direction substantially parallel to the axis;

a second annular wall oriented substantially perpendicular to the axis and offset in said first axial direction from said first annular wall, said second annular wall being attached to said first annular wall; and a plurality of second support ridges projecting from said second wall in a second axial direction substantially opposite to said first axial direction.

21. The flange of claim 20, wherein sets of said first support ridges and sets of said second support ridges are alternatingly disposed in a circumferential direction.

22. The flange of claim 20, wherein said first support ridges are oriented in both a first radial direction and a first circumferential direction, and said second support ridges are oriented in both a second radial direction and a second circumferential direction.

23. The flange of claim 20, further comprising at least one connecting wall interconnecting said first annular wall and said second annular wall.

24. A flange for use in a reel for supporting a wound flexible medium, the reel including an elongated core defining a longitudinal core axis, the flange comprising:

a first annular wall oriented substantially perpendicular to the axis and configured to engage the core;

a second annular wall oriented substantially perpendicular to the axis and offset in a first axial direction from said first annular wall, said second annular wall being attached to and disposed radially outward of said first annular wall;

a beam wall oriented substantially coplanar with said first annular wall and disposed radially outward of said first annular wall;

at least one connecting wall interconnecting said second annular wall and said beam wall, said beam wall and said at least one connecting wall defining a support beam therebetween; and a plurality of first support ridges projecting from said beam wall in the first axial direction.

25. The flange of claim 27, further comprising a plurality of second support ridges projecting from said second annular wall in a second axial direction substantially opposite to said first axial direction.

26. The flange of claim 25, wherein sets of said first support ridges and sets of said second support ridges are alternatingly disposed in a circumferential direction.

27. The flange of claim 25, wherein said second support ridges are oriented in both a radial direction and a circumferential direction.

28. The flange of claim 25, wherein at least one of said second support ridges is circumferentially aligned with an end wall of said support beam.

29. The flange of claim 28, further comprising an annular rim attached to said second annular wall and oriented substantially parallel to the axis, said rim being offset in a radially outward direction from said end wall of said support beam.

30. The flange of claim 24, wherein said at least one connecting wall comprises a plurality of connecting walls, at least one of said first support ridges being attached to at least one corresponding one of said connecting walls.

31. The flange of claim 24, wherein said first support ridges are oriented in both a radial direction and a circumferential direction.

32. A flange for use in a reel for supporting a wound flexible medium, the reel including an elongated core defining a longitudinal core axis, the flange comprising:

a substantially planar first web oriented substantially perpendicular to the axis, said first web including:

a center portion configured to engage the core; and a radially-oriented finger emanating from said center portion;

a substantially planar second web oriented substantially perpendicular to the axis and offset in a first axial direction from said first web, said second web being attached to and disposed radially outward of said first web;

at least one connecting wall interconnecting said second web and said finger of said first web, said finger and said at least one connecting wall defining a support beam therebetween; and a plurality of first support ridges projecting from said finger in the first axial direction.

33. The flange of claim 32, further comprising a plurality of second support ridges projecting from said second web in a second axial direction substantially opposite to said first axial direction.

34. The flange of claim 33, wherein sets of said first support ridges and sets of said second support ridges are alternatingly disposed in a circumferential direction.

35. The flange of claim 33, wherein said second support ridges are oriented in both a substantially radial direction and a substantially circumferential direction.

36. The flange of claim 33, wherein at least one of said second support ridges is circumferentially aligned with an end wall of said support beam.

37. The flange of claim 36, further comprising an annular rim attached to said second web and oriented substantially parallel to the axis, said rim being offset in a radially outward direction from said end wall of said support beam.

38. The flange of claim 32, wherein said at least one connecting wall comprises a plurality of connecting walls, at least one of said first support ridges being attached to at least one corresponding one of said connecting walls.

39. The flange of claim 32, wherein said first support ridges are oriented in both a substantially radial direction and a substantially circumferential direction.

40. The flange of claim 32, wherein said center portion of said web is substantially annular.

* * * * *